US008747571B2

(12) United States Patent
Calhoun et al.

(10) Patent No.: US 8,747,571 B2
(45) Date of Patent: Jun. 10, 2014

(54) DISHWASHING MACHINE TANK

(75) Inventors: James S. Calhoun, Corbin, KY (US); Paul Wells, Corbin, KY (US); Abel A. Arellano, London, KY (US)

(73) Assignee: Jackson WWS, Inc., Barbourville, KY (US)

( * ) Notice: Subject to any disclaimer, the term of this patent is extended or adjusted under 35 U.S.C. 154(b) by 902 days.

(21) Appl. No.: 12/459,776

(22) Filed: Jul. 8, 2009

(65) Prior Publication Data

US 2010/0065093 A1 Mar. 18, 2010

Related U.S. Application Data

(60) Provisional application No. 61/134,201, filed on Jul. 8, 2008.

(51) Int. Cl.
*B08B 3/00* (2006.01)

(52) U.S. Cl.
USPC ..... 134/56 D; 134/57 D; 222/184

(58) Field of Classification Search
USPC ..... 134/56 R
See application file for complete search history.

(56) References Cited

U.S. PATENT DOCUMENTS

| | | | | |
|---|---|---|---|---|
| 3,049,450 | A * | 8/1962 | Koons et al. | 134/11 |
| 4,098,545 | A * | 7/1978 | Gaiser et al. | 312/228 |
| 4,919,162 | A * | 4/1990 | Lumby et al. | 134/115 R |
| 6,045,203 | A * | 4/2000 | Marks et al. | 312/228 |
| 2002/0092329 | A1 * | 7/2002 | Rhode et al. | 68/24 |

* cited by examiner

*Primary Examiner* — Jason Ko
(74) *Attorney, Agent, or Firm* — Nelson Mullins Riley & Scarborough, LLC

(57) ABSTRACT

A dishwashing machine includes a tub having a sidewall. The sidewall has a first wall and a second wall connected by a bottom wall. The sidewall is connected to a first end wall and a second end wall. The first end wall is connected to the first wall, the second wall, and the bottom wall on a first end of the sidewall and the second end wall is connected to the first wall, the second wall, and the bottom wall on a second end of the sidewall forming an interior volume. The tub has the same amount of welding regardless of a length of the sidewall.

15 Claims, 7 Drawing Sheets

DISHWASHING MACHINE TANK

CROSS-REFERENCE TO RELATED APPLICATIONS

This application claims the benefit of U.S. Provisional Application No. 61/134,201, filed Jul. 8, 2008. U.S. Provisional Application No. 61/134,201, filed Jul. 8, 2008 is hereby incorporated by reference in its entirety.

BACKGROUND OF THE INVENTION

1. Field of the Invention

The present disclosure relates generally to dishwashing machines. More particularly, the present disclosure relates to a dishwashing machine tank having a tub, a hood, or combination thereof and method of making the dishwashing machine tank.

2. Description of Related Art

Dishwashing machine tanks generally include a tub that collects and holds liquid used to clean wares such as, glasses, utensils, plates, and the like. Typical tubs have tub walls that enclose an interior volume to hold the liquid on one side and are exposed to the ambient environment on an opposite side. The shapes of conventional tubs have an undesirable amount of water in contact with tub walls. In addition, one or more of the tub walls may be shaped to function as angled runoff surfaces so that liquid sprayed inside of the dishwashing machine contacts the runoff surfaces. The liquid cools down significantly once contact is made with the tub walls due to energy transfer from the liquid through the tub walls to the ambient environment and is lost from the system resulting in an increase in energy and/or water consumption and inefficiency in operation.

Dishwashing machine tanks require an undesirable amount of welding and connecting components such as bolts. The amount of welding and connecting components weaken the dishwashing machine tank. Undesirable types of welding are required for conventional dishwashing tanks, such as, metal inert gas (MIG) welding that causes fumes that are unsafe for workers.

Different sizes of dishwashing tanks generally require a different amount of connections, such as welding and nuts and bolts. Further, a different design and manufacture is required for each different type of model that increases, cost, tooling, and many other manufacturing costs.

Accordingly, it has been determined by the present disclosure, there is a need for a reduction in heat or energy transfer from the dishwashing tank to the ambient air. There is a further need to reduce the amount of welding and connecting components of the dishwashing tank. There is still a further need for a dishwashing tank that does not require a different amount of connections and a different design and manufacture for each different type of model of dishwashing machine.

BRIEF SUMMARY OF THE INVENTION

A dishwashing machine tank is provided that includes a tub having a sidewall that is curved, a first end wall on a first side of the sidewall and a second end wall on a second side of the sidewall opposite the first end wall enclosing a volume for holding liquid.

A dishwashing machine tank is also provided that includes a hood having a sidewall that is curved, a first end wall on a first side of the sidewall and a second end wall on a second side of the sidewall opposite the first end wall enclosing a volume.

A dishwashing machine includes a tub having a sidewall. The sidewall has a first wall and a second wall connected by a bottom wall. The sidewall is connected to a first end wall and a second end wall. The first end wall is connected to the first wall, the second wall, and the bottom wall on a first end of the sidewall and the second end wall is connected to the first wall, the second wall, and the bottom wall on a second end of the sidewall forming an interior volume. The tub has the same amount of welding regardless of a length of the sidewall.

The above-described and other advantages and features of the present disclosure will be appreciated and understood by those skilled in the art from the following detailed description, drawings, and appended claims.

DETAILED DESCRIPTION OF THE INVENTION

Figure 1:
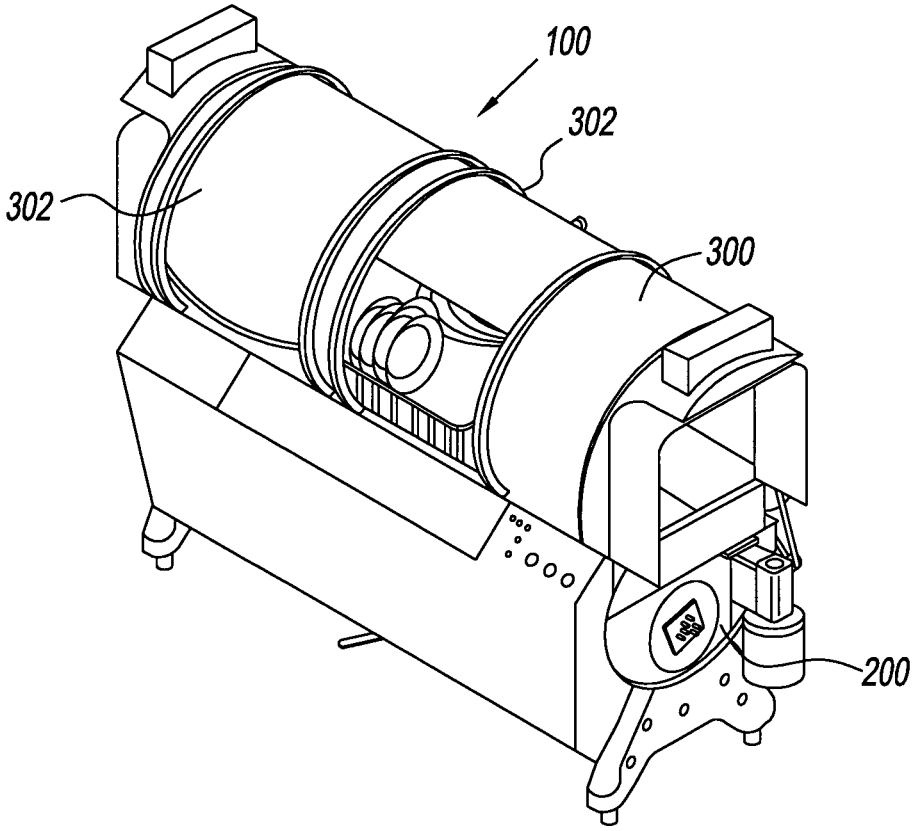
FIG. 1 is a front perspective view of an exemplary embodiment of a dishwashing machine having a dishwashing tank according to the present disclosure having a tub and a hood having a door in an open position and a door in a closed position.

Referring to the drawings and in particular to FIG. 1, an exemplary embodiment of a dishwashing machine having a tank, according to the present disclosure is generally referred to by reference numeral 100. Tank 100 has a tub 200 and a hood 300. Tank 100 may be used with any dishwashing machine, such as, for example, conveyor, doortype, undercounter, glasswasher, or flight machines that have a power source such as, for example, steam, gas, electric, or any combination thereof.

Referring to FIGS. 2 through 5, tub 200 has a tub wrap 205 connected to a first tub end piece 210 and a second tub end piece 215 enclosing an interior volume 240.

Tub wrap 205 and first tub end piece 210 and second tub end piece 215 have a complementary shapes. First tub end piece 210 and second tub end piece 215 may have a size that is less than or equal to the cross-section size of tub wrap 205 to fit within tub wrap 205. First tub end piece 210 and second tub end piece 215 may each have a flange 211. Flange 211 strengthens the end of tub 200 and allows for attachment of, for example, a table.

Figure 5:
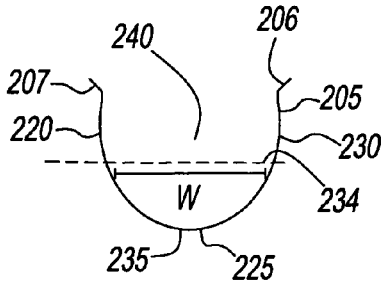
FIG. 5 is a cross-sectional view taken along line 5-5 of FIG. 2.

Tub wrap 205 has a first sidewall 220, a bottom wall 225, and a second sidewall 230. Bottom wall 225 is curved or has a cross-section that decreases in width W from first sidewall 220 and second sidewall 230 to a bottom point 235, as shown in FIG. 5. Bottom wall 225, preferably, is at or below the waterline during use of the dishwashing machine. The waterline is high enough to cover heaters (not shown) within tub 200 and below scrap trays (not shown), such as, for example, the waterline is at or above reference numeral 25*a* in FIG. 10.

First sidewall 220 and second sidewall 230 have an angle that is formed with a horizontal plane 234 that passes through tub wrap 205. The angle is optimized to minimize a time water that contacts first sidewall 220 or second sidewall 230 remains on first sidewall 220 or second sidewall 230. The angle between horizontal plane 234 and each of first sidewall 220 and second sidewall 230 preferably, is about 70 degrees to about 90 degrees, and more preferably, is about 90 degrees.

Tub wrap 205 may have a first bend 206 and a second bend 207. First bend 206 and second bend 207 strengthen the edges of tub 200.

Figure 2:
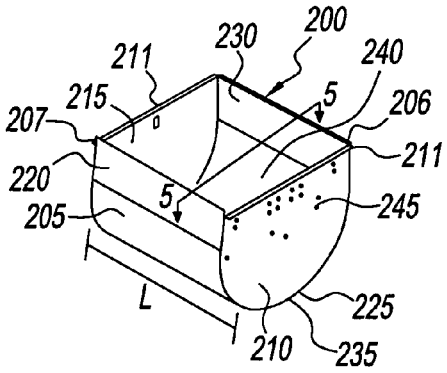
FIG. 2 is a front perspective view of an exemplary embodiment of a tub according to the present disclosure.
Figure 3:
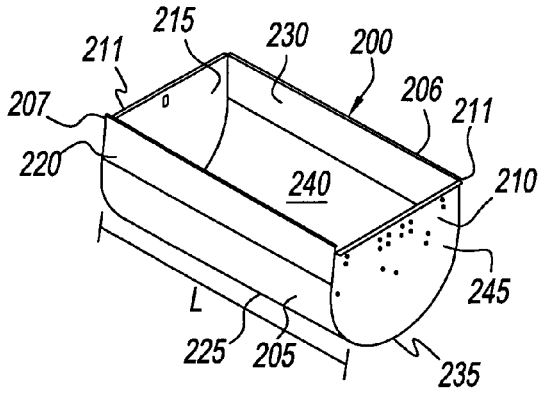
FIG. 3 is a front perspective view of another exemplary embodiment of a tub according to the present disclosure.
Figure 4:
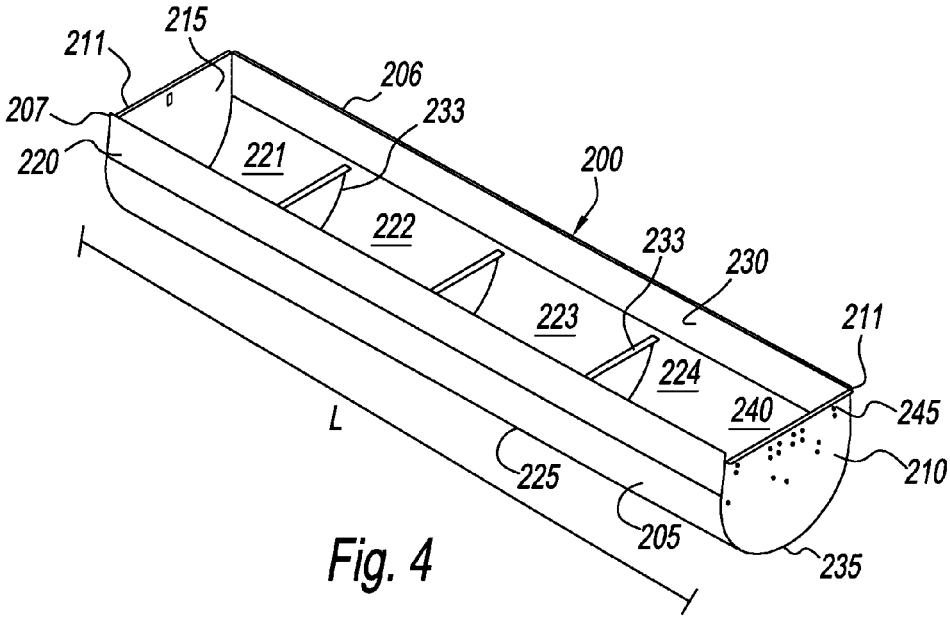
FIG. 4 is a front perspective view of another exemplary embodiment of a tub according to the present disclosure.

Tub 200 may be any size, such as, for example, a length L of 25 inches for door type machine tubs as shown in FIG. 2, length L of 44 inches for single tank tubs as shown in FIG. 3, and length L of 120 inches of a multi-tank tub as shown in FIG. 4. The multi-tank tub has partitions 233 that may be welded in interior volume 240 to tub wrap 205, such as, for example, by stitch welding or spot welding. For example, a multi-tank tub may have a prewash tank 221 separated from a first wash tank 222 by one of partitions 233, a second wash tank 223 separated from first wash tank 222 by one of partitions 233, and a power rinse tank 224 separated from second wash tank 223 by one of partitions 233.

Tub 200 may have one or more projection studs 245. Projection studs 245 are projections that extend from tub 200. Projection studs 245 may be threaded to mate with screws. Projection studs 245 may be utilized at all points where attachments are to be made to tub 200. Projection studs 245 are "self fixturing" and eliminate a need for stud location fixtures. Projection studs 245 also reduce assembly time by freeing hands normally required during tightening of nuts and bolts. Projection studs 245 may replace any or all bolts. It is contemplated by the present disclosure that tub 200 may use nuts, bolts, and any connection devices.

It has been found by the present disclosure that tub 200 maintains a greater volume to surface area ratio of liquid than tubs having other shapes. The curved or decreasing cross-section shape of bottom wall 225 and minimized sloping sides of first sidewall 220 and second sidewall 230 reduce a surface area of tub 200 as compared to an equivalent volume of liquid in tubs that have a non-curved or a cross-section that does not decrease in width or with angled sides that are not minimized. For example, a typical 44 inch tub that has a square shape holds approximately 22 gallons of liquid. A tub of the present disclosure holds approximately 33 gallons of liquid. This greater volume or "battery" of water in interior volume 240 can maintain a higher temperature due to an ability to absorb the same amount of cooler water that results in the washing process. Advantageously, greater ware throughput may be achieved by maintaining a higher temperature with the same heat input. The reduction in surface area reduces heat lost from liquid in interior volume 240 through tub wrap 205, first tub end 210, and second tub end 215 to the ambient environment due to less contact with tub 200. This may allow for the reduction of material thickness and/or the reduction of any insulating material that may be required. The geometry will meet all the above criteria if sloping sides above the tank water level are minimized. The tank design below water level may have polygonal features.

When a dishwashing machine including tub 200 is idle or in between uses, a slightly higher temperature may be at a top of tub 200 than at a bottom of tub 200. Hot water rises and cold water settles. For example, a tub having a square cross-section having a thermostat set at 160 degrees Fahrenheit, an amount of water at a top of the tub having a higher temperature is equal to an amount of water at a bottom of the tub having a lower temperature than the higher temperature at the top of the tub. Due to the curved or decreasing cross-section shape of bottom wall 225 and minimized sloping sides of first sidewall 220 and second sidewall 230, a top of tub 200 has a greater amount of water at the higher temperature than a bottom of tub 200 having a smaller amount of water than the top of tub 200 at a lower temperature than the top of tub 200 with a thermostat set, for example, at 160 degrees Fahrenheit. Thus, when the dishwashing machine goes from idle to use, a pump mixes a greater amount of water with the higher temperature than the lower temperature in the bottom of the tub leading to a higher average temperature of the water in the tub of the dishwashing machine and increased efficiency of dishwashing machines having tub 200.

Figure 10:
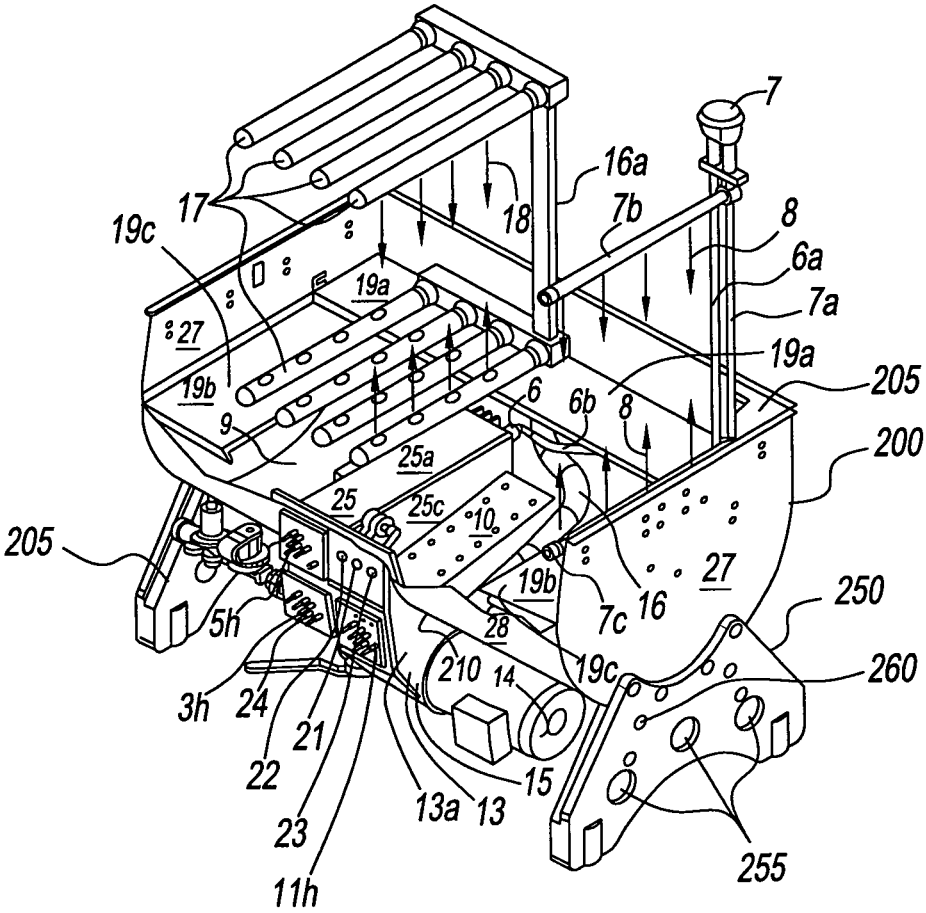
FIG. 10 is a front perspective view of an exemplary embodiment of a dishwashing machine showing a partial dishwashing tank according to the present disclosure.

It has also been found by the present disclosure that tub 200 allows liquid dispensed into tub 200 to immediately fall into a battery 9, as shown in FIG. 10. Advantageously, contact with walls that have a side exposed to the ambient is minimized by first sidewall 220 and second sidewall 230 having a minimal or no angle. Energy transfer or cooling of the liquid caused when water returns via sloped tub sides whose opposite surface is exposed to the air is minimized. Tub 200 allows for the rapid return of liquid to a sump area 10 therefore maintaining pump suction head.

Referring to FIG. 10, tub 200 may have one or more internal angled runoffs 19*a*, 19*b*. Internal angled runoffs 19*a*, 19*b* are connected to interior volume 240 and have a surface 19*c* to direct liquid flowing into tub 200. Surface 19*c* is within interior volume 240. Internal angled runoffs 19*a*, 19*b* direct liquid away from tub wrap 205, first tub end piece 210, and second tub end piece 215 that has the ambient environment on one side to reduce energy transfer from the liquid and tub wrap 205, first tub end piece 210, and second tub end piece 215. For example, a final rinse water spray 8 is directed over wares and falls toward a battery of wash tank water 9 in tub 200 via internal angled runoffs 19*a*, 19*b*. The heat retained within the final rinse water (minus the heat transferred to the wares) is conserved by internal angled runoffs 19*a*, 19*b* increasing efficiency of the dishwashing machine, such as for example, raising water temperature within tub 200 by about 5 degrees Fahrenheit higher than a temperature in a tub having angled runoffs as tub walls that are exposed to the ambient environment.

The use of internal angled runoffs 19*a*, 19*b* without additional angled runoffs eliminates all bends and associated angled runoffs above a tub water level. Angled runoffs that are included in a tub wall can greatly reduce the thermal efficiency of the tub due to wash water that is sprayed by the wash arms and falls onto angled runoffs and is cooled due to the ambient air temperature on the opposite side of the angled runoffs. Internal angled runoffs 19*a*, 19*b* may be maintained at an operating chamber temperature of the dishwashing machine. For example, cooling of the falling wash tank water 18 is minimized by returning to battery of wash tank water 9 by one of two routes: (1) directly upon the scrap trays (not shown) and directly into the battery of water 9 or (2) onto the internal angled runoffs 19*a*, 19*b* and is directed to the scrap trays and then falls into the battery of water.

Figure 11:
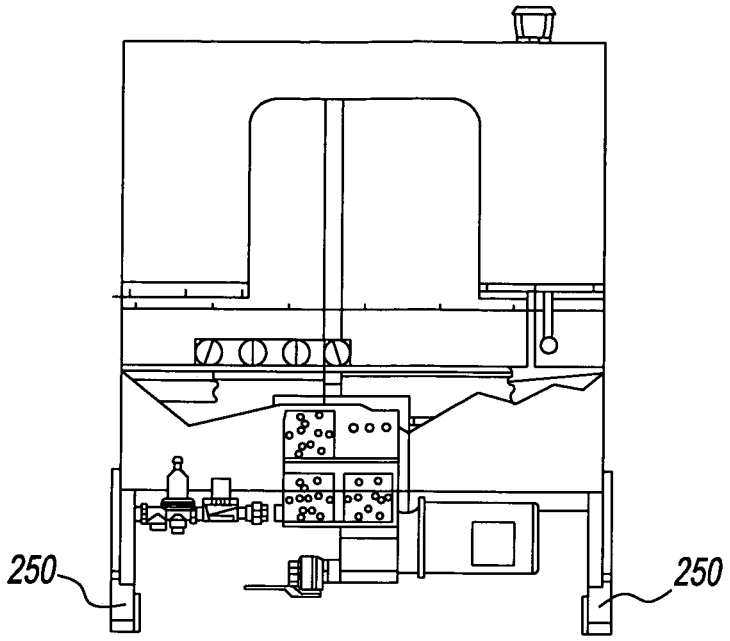
FIG. 11 is a front view of the exemplary embodiment of FIG. 10 having a hood.
Figure 12:
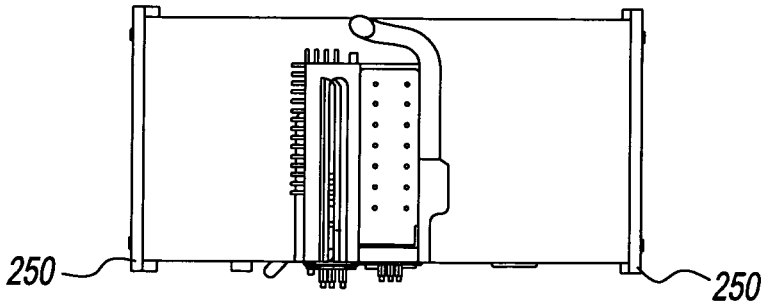
FIG. 12 is a cross-section view taken along line E-E of the FIG. 11.

Referring to FIGS. 10 through 12, tub 200 allows for the surface area at a water level height to be approximately an area covered by length L1 and width W1, as shown in FIG. 12, allowing for a greater volume of water 9 to be available in tub 200 than for units which incorporate the angled runoffs within the design of the tub walls decreasing a surface area by the angled runoffs. This greater volume or "battery" of water can maintain a higher temperature due its ability to absorb the same amount of cooler water that results in the washing process. This will enable greater ware throughput.

Tub 200 may be formed by method of manufacture described herein that includes 5 processes. Tub wrap 225 that has a curved or circular bottom wall 225, advantageously, reduces a number of bends required during fabrication. Tub wrap 225 may be formed by a first rolling process. The first rolling process may be performed, for example, by a break press machine or rotomolding. First bend 206 and second bend 207 may also be formed in a second and a third bending process. Second and third bending processes maybe stamped. First tub end piece 210 and second tub end piece 215 may be stamped with flange 211 in a fourth and a fifth process. In contrast, a typical standard tub in its simplest form (44" Conveyor) normally requires 16 total bends of varying dimensions.

Bends and flanges may be a standard dimension that prevent excessive tolerance buildup. The reduction of a total amount of bends and flanges of tub 200 decreases a tolerance buildup and reduces an amount of gaps for welding created by a bend being out of tolerance. A gap is created when a first portion connects with another portion of the tub and the first portion of a tub has a bend that out of tolerance. For example, a tub that requires 16 bends that permits a tolerance of 0.02 inches per bend may be out of tolerance by 0.02 inches for each bend or 0.02 inches multiplied by 16 so that the tub may be out of tolerance as much as 0.32 inches. In contrast, flange 211 of each of first tub end piece 210 and second tub end piece 215 each are outside of a connection or weld with tub wrap 205, so that flanges 211 cannot form a gap and do contribute to a tolerance build up. Tub wrap 205 eliminates all bends except for first bend 206 and second bend 207 eliminating welds so that there is no tolerance build up along length L. Even if tub wrap 205 is cut to an incorrect length L, first tub end piece 210 and second tub end piece 215 will still fit with tub wrap 205.

Tub 200 has a shape that has increases strength by eliminating flat surfaces that may bow and/or warp under a weight of bolted on assemblies as well as the deformation caused during heat of welding. This additional strength allows for the reduction of material gauge. The material gauge may be reduced from 16 gauge to a range of 18 gauge to 20 gauge therefore reducing cost and machine weight. Tub 200 has a shape that is conducive to roto-molding when plastic designs are considered. Rotomolding may include a mold that is placed in a molding machine that has a loading, heating, and cooling area; pre-measured plastic resin is loaded into each mold; and the molds are moved into the oven where they are slowly rotated on both the vertical and horizontal axis so that the melting resin sticks to the hot mold and coats every surface evenly, and the mold continues to rotate during the cooling cycle so the parts retain an even wall thickness.

First tub end piece 210 and second tub end piece 215 may be welded, preferably seam welded, to tub wrap 205. Seam welding eliminates a need for MIG welding that may cause unsafe fumes; however, any welding may be used.

Tub 200 may have the same amount of welded joint regardless of length L due to a uniform cross-section along length L and due to welding only first tub end piece 210 and second tub end piece 215 to tub wrap 205. First tub end piece 210 and second tub end piece 215 may be exactly the same regardless of length L of tub 200. For example, a 25 inch door type machine will have the same overall weld length as a 120 inch conveyor type tub. Tub 200 may be any length reducing manufacturing costs for production of multiple types of dishwashing machines. As shown in FIG. 4, partitions 233 may increase welding if included. Tub 200 may have at least 30 percent less welding than conventional tubs.

Tub wrap 205 may be rolled to conform to first tub end piece 210 and second tub end piece 215. Tub wrap 205 functions as self fixturing device by applying a force onto first tub end piece 210 and second tub end piece 215 maintaining placement thereof. For example, first tub end piece 210 and second tub end piece 215 are positioned within tub wrap 205 so that tub wrap 205 applies an inward force by first sidewall 220, bottom wall 225, and second sidewall 230 onto first tub end piece 210 and second tub end piece 215.

Preferably, the welded portions of tub 200 are free of bends or flanges, which eliminates potential gaps created during the weld process. This allows for varying weld processes to be utilized, for example, butt joint weld, seam weld, and is conducive to robotic welding as well. Corners are greatly reduced in number and therefore potential crud traps with associated bacterial growth are eliminated allowing for ease of cleaning, and conforms closely to existing National Sanitation Foundation (NSF) and health code standards.

Advantageously, tub 200 allows for easy installation of insulation by providing one continuous surface unbroken by sharp bends, and reduces material waste from cutting and piecing together of insulation.

Referring to FIGS. 10 through 12, tub 200 may have a plurality of supports 250. Supports 250 are removably connectable to tub 200. Supports 250 accept standard adjustable foot designs. Supports 250 eliminate a welded frame structure. However, it is contemplated by the present disclosure for use of tub 200 with a welded structure.

Supports 250, such as, for example, may be made of cast metal, molded polyvinyl chloride (PVC) or molded ultra high molecular weight polyethylene (UHMW-PE). Supports 250 may have one or more cutouts or recesses 255 for support cross members (not shown). Cross members may extend from one of recesses 255 of one support 250 to another of recesses 255 on another support 250. Cross members are provided for the purpose of shipping/lifting. Cross members can be removed after installation to provide for increased access under tub 200 to aid in service/cleaning. Holes 260 may be incorporated in supports 250 to provide for easy running of electrical conduit, plumbing systems and/or the reduction of material cost during the casting or molding process. Cutouts or recesses 255 may be maximized to reduce an amount of material needed for supports 250 while still maintaining the structural integrity of supports 250.

Figure 6:
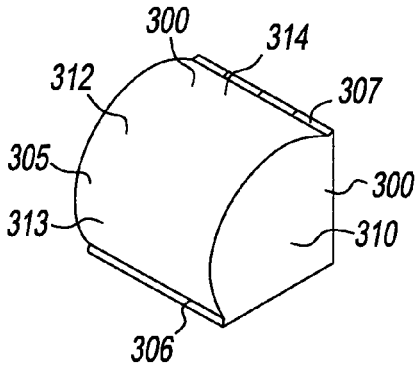
FIG. 6 is a front perspective view of an exemplary embodiment of a hood according to the present disclosure.
Figure 7:
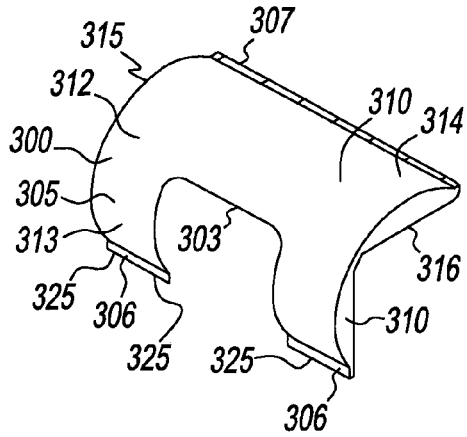
FIG. 7 is a front perspective view of another exemplary embodiment of a hood according to the present disclosure.
Figure 8:
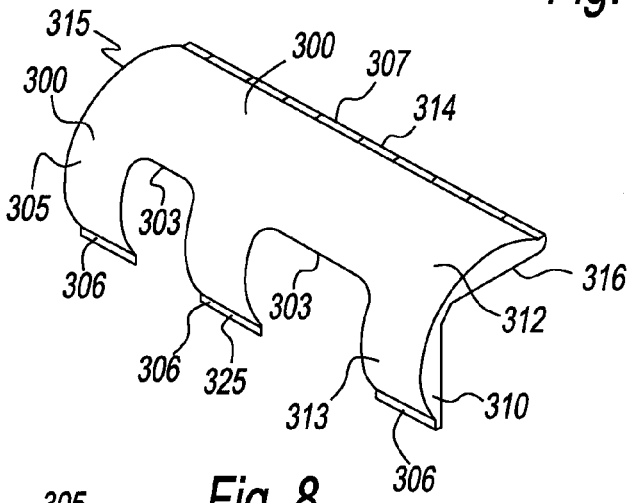
FIG. 8 is a front perspective view of another exemplary embodiment of a hood according to the present disclosure.
Figure 9:
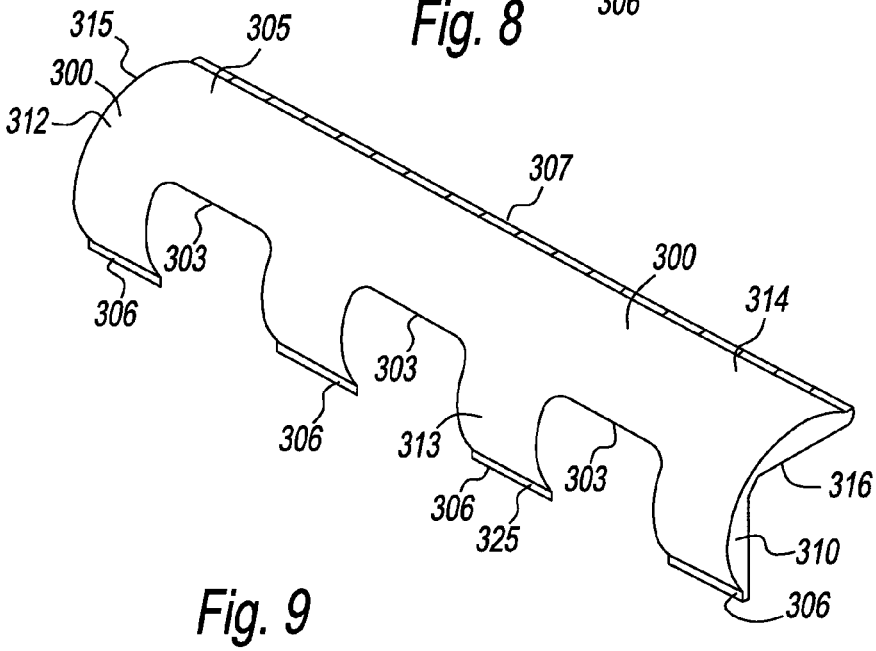
FIG. 9 is a front perspective view of another exemplary embodiment of a hood according to the present disclosure.

Referring to FIGS. 6 through 9, hood 300 has a hood wrap 305, a first hood end piece 310, and a second hood end piece 315. Hood wrap 305, first hood end piece 310 and second hood end piece 315 have complimentary shapes. As shown in FIGS. 7 through 9, first hood end piece 310 and second hood end piece 315 may have cutouts 316. Cutouts 316 allow for conveyors to pass through hood 300. As shown in FIG. 6, first hood end piece 310 and second hood end piece 315 may be free of cutouts 316 to provide further cover with hood 300.

Hood wrap 305 is curved. Hood wrap may have a top portion 312 between a first side 313 and a second side 314 of a sidewall. First side 313 and second side 314 have an angle that is formed with a horizontal plane that passes through hood wrap 305. The angle is optimized to minimize a time water that contacts first side 313 or second side 314 remains on first side 313 or second side 314. The angle between the horizontal plane and first side 313 and second side 314 preferably, is about 70 degrees to about 90 degrees, and more preferably, is about 90 degrees.

Hood wrap 305 may have a first bend 306 on a first side of hood wrap 305 and a second bend 307 on an opposite side of hood wrap 305. Hood 300 may be of any size, such as, for example, a door type hood as shown in FIG. 6, a single tank machine hood as shown in FIG. 7, a multi-tank machine hood as shown in FIG. 8, and a large multi-tank and flight type hood as shown in FIG. 9. Hood 300 may have one or more doors 302, as shown in FIG. 1, that move from an open position to a closed position. One or more doors 302 may be connectable to hood wrap 305 on one or more door slots 303.

Hood 300 has a similar fabrication process as tub 200 described herein. Hood 300 has a curved or circular shape that reduces a number of bends required during fabrication. Hood wrap 305 requires one bend and one rolling process. The rolling process may be performed by a break press machine or rotomolding and the bending processes maybe stamped. In contrast, a standard hood in its simplest form (44" Conveyor) normally requires 8 bends of varying dimensions. The fabrication process or method of manufacture will prevent excessive tolerance buildup. Similar to tub 200 discussed herein, the reduction of a total amount of bends and flanges of hood 300 decreases a tolerance buildup and reduces an amount of gaps for welding created by a bend being out of tolerance. Hood wrap 305 eliminates all bends except for first bend 306 and second bend 307 eliminating welds so that there is no tolerance build up along length L. Even if hood wrap 305 is cut to an incorrect length L, first hood end piece 310 and second hood end piece 315 will still fit with hood wrap 305.

The rounded geometry of hood 300 has additional strength by eliminating flat surfaces that may bow and/or warp under the weight of bolted on assemblies as well as the deformation caused during the heat of welding. This additional strength can allow for the reduction of material gauge therefore reducing cost and machine weight.

Hood wrap 305 conforms to rounded first hood end piece 310 and second hood end piece 315 which act as self fixturing devices, similar to tub wrap 205 described herein. Hood wrap 305 applies a force onto first hood end piece 310 and second hood end piece 315 maintaining placement thereof.

Hood 300 allows for seam welding of hood wrap 305, a first hood end piece 310, and a second hood end piece 315 when the end pieces are stamped with a flange, as discussed above for tub 200. Similar to tub 200 discussed herein, hood 300 may have the same amount of welded joint regardless of the overall length of the hood due to welding only first hood end piece 310 and a second hood end piece 315 to hood wrap 305. For example, a 44 inch conveyor machine has the same overall weld length as a 120 inch conveyor type hood.

There are no bends along the welded portion of the hood which eliminates potential gaps created during the weld process. This allows for varying weld processes to be utilized, such as, for example, butt joint weld, seam weld, and is conducive to robotic welding as well.

Hood 300 may have one or more slots 325. Slots 325 may be on first bend 306 and/or second bend 307. Slots 325 may be used at points where attachments are to be made to projection studs 245. Slots 325 reduce assembly time by freeing hands normally required for aligning holes and the tightening of nuts and bolts. Hood 300 can rest on projection studs 245 of tub 200 during assembly making handling of the tub an easier task.

It has been found by the present disclosure, similar to tub 200, hood 300 allows for ease of cleaning. Corners are greatly reduced in number and therefore potential crud traps with associated bacterial growth are eliminated. This conforms closely to existing NSF and health code standards. Hood 300 allows for easy installation of insulation by providing one continuous surface unbroken by sharp bends. This will reduce material waste from the cutting and piecing together of insulation if used. Similar to tub 200, hood 300 is conducive to roto-molding when plastic designs are considered.

Figure 13:
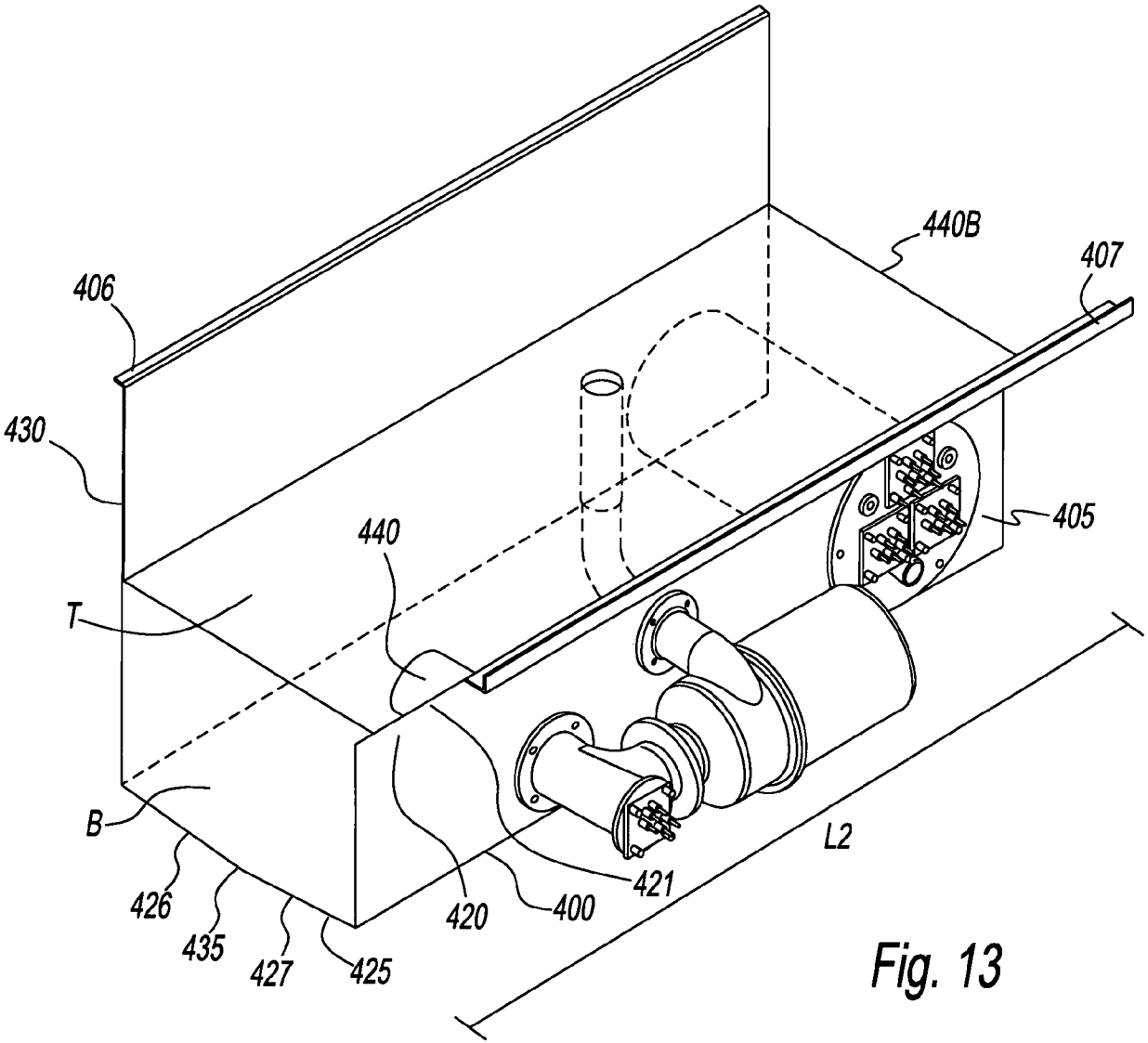
FIG. 13 is a front perspective view of an exemplary embodiment of a dishwashing machine having a dishwashing tank according to the present disclosure having a tub.
Figure 14:
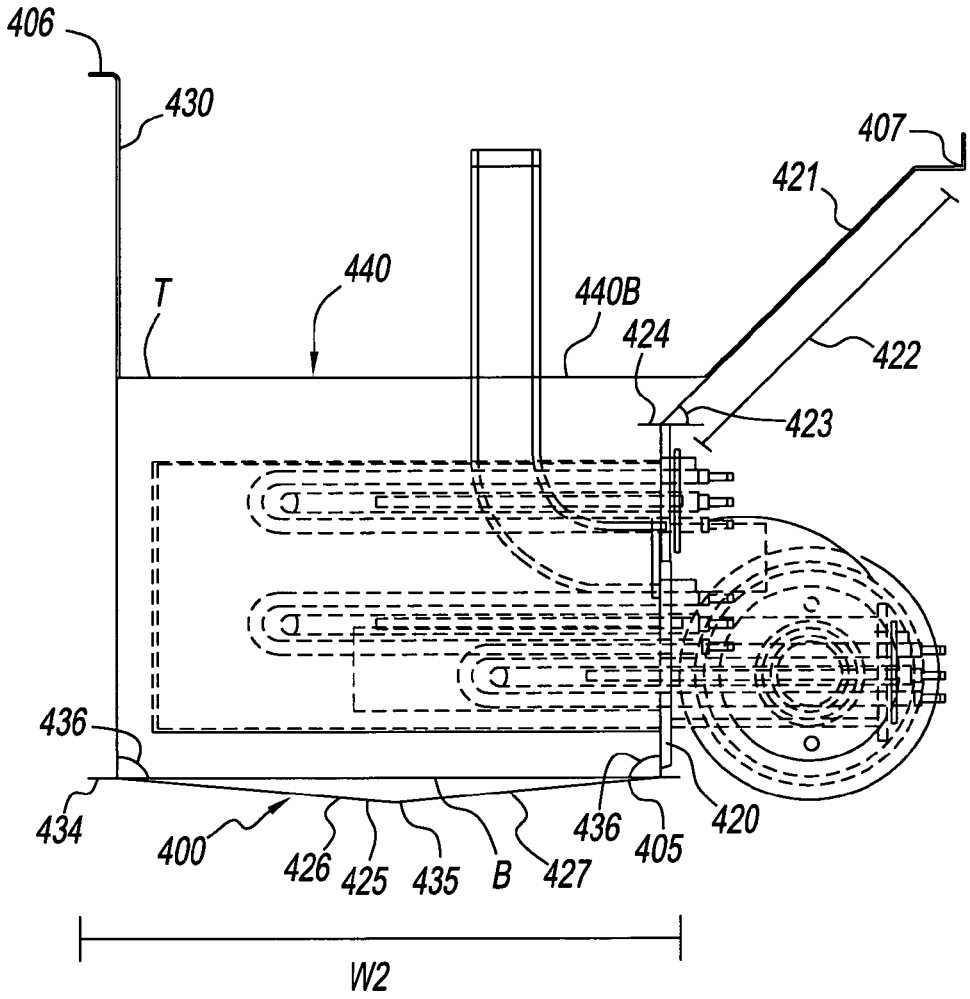
FIG. 14 is a cross-section view of the FIG. 13.

FIGS. 13 and 14 show an exemplary embodiment of a dishwashing machine having a dishwashing tank according to the present disclosure having a tub 400. Tub 400 has tub wrap 405. Tub wrap 405 has a first sidewall 420, a bottom wall 425, and a second sidewall 430. Tub wrap 405 is similar to tub wrap 205, however, tub wrap 405 has a first bottom side portion 426 and a second bottom side portion 427 that are substantially uncurved or linear to form a cross-section that decreases in width W2 from first sidewall 420 and second sidewall 430 to a bottom point 435 and tub wrap 405 has first sidewall 420 having an upper portion 421 that is bent outward and second sidewall 430 that can extend above, be the same height or be lower than first sidewall 420. All walls and/or bends within walls of tub 400 are to be submerged below an operating water level 440B as much as possible in order to reduce cooling of runoff water.

As shown in FIG. 14, first sidewall 420 and second sidewall 430 have an angle 436 that is formed with a horizontal plane 434 that passes through tub wrap 405. Angle 436 is optimized to minimize a time water that contacts first sidewall 420 or second sidewall 430 remains on first sidewall 420 or second sidewall 430. Angle 436 between horizontal plane 435 and each of first sidewall 420 and second sidewall 430 preferably, is about 70 degrees to about 90 degrees, and more preferably, is about 90 degrees. First sidewall 420 and second sidewall 430 may be planar or linear so that warewasher components such as pumps may be mounted thereon with ease.

Second sidewall 430 may have a bend 406 and first sidewall 420 may have a bend 407. Bends 406 and 407 strengthen the edges of tub 400. Bend 406 and bend 407 strengthen edges of tub 400 to minimize deformation and allow for attachment of a hood to tub 400. Upper portion 421 of first sidewall 420 has a length 422 that is minimized and an angle 423 between upper portion 421 and a horizontal axis 424 that is maximized to allow for quicker runoff of water to the water in interior volume 440.

Similar to tub 200, it has been found by the present disclosure that the cross sectional area of the volume water in interior volume 440 is the same for the entire length of the tub and maximizes the volume of water. This greater volume or "battery" of water in interior volume 440 can maintain a higher temperature due to an ability to absorb the same amount of cooler water that results in the washing process. Advantageously, greater ware throughput may be achieved by maintaining a higher temperature with the same heat input. The reduction in surface area reduces heat lost from liquid in interior volume 440 through tub wrap 405, first tub end, and second tub end to the ambient environment due to less contact with tub 400. This may allow for the reduction of material thickness and/or the reduction of any insulating material that may be required. The geometry will meet all the above criteria if angle 436 of first sidewall 420 and second sidewall 430 above the tank water level are minimized.

It has also been found by the present disclosure, similar to tub 200, that tub 400 allows liquid dispensed into tub 400 to immediately fall into interior volume 440. Advantageously, contact with walls that have a side exposed to the ambient is minimized by first sidewall 420 and second sidewall 430 having a minimal or no angle to be substantially vertical or have angle 436 of about 90 degrees. Energy transfer or cooling of the liquid caused when water returns via sloped tub sides whose opposite surface is exposed to the air is minimized. Tub 400 allows for the rapid return of liquid to a sump area in interior volume 440 therefore maintaining pump suction head.

Tub 400 may have one or more internal angled runoffs (not shown) similar to internal angled runoffs 19*a*, 19*b* shown in FIG. 10. Internal angled runoffs are connected to interior volume 440 and have a surface to direct liquid flowing into tub 400. The surface of the internal angled runoffs is within interior volume 440. The internal angled runoffs direct liquid away from tub wrap 405, the first tub end piece, and the second tub end piece that has the ambient environment on one side to reduce energy transfer from the liquid and tub wrap 405, the first tub end piece, and the second tub end piece. Similar to final rinse water spray 8 of tub 200 that is directed over wares and falls toward a battery of wash tank water 9 in tub 200 via internal angled runoffs 19*a*, 19*b*, the heat retained within the final rinse water (minus the heat transferred to the wares) is conserved by the internal angled runoffs increasing efficiency of the dishwashing machine, such as for example, raising water temperature within tub 400 by about 2 to 5 degrees Fahrenheit higher than a temperature in a tub having angled runoffs as tub walls that are exposed to the ambient environment. The internal angled runoffs may be planar having a first surface and a second surface opposite the first surface so that an edge is attached to interior volume 440 and the first surface and second surface extend into interior volume 440. The internal angled runoffs may be angled downward toward bottom wall 425 to direct water entering tub 400 within interior volume 440.

The use of the internal angled runoffs without additional angled runoffs may eliminate all bends and associated angled runoffs above a tub water level. However, upper portion 421 may be included in tub 400 to function as an angled runoff to direct water into tub 400. Upper portion 421 may have insulation connected to a side that is exposed to the ambient surrounding air to minimize heat transfer between water entering tub 400 and the ambient air. In addition, a tub width from first sidewall 420 below upper portion 421 to second sidewall 430 along horizontal plane 434 that is the same dimension as a hood dimension of a hood that is connected to tub 400 may not be practical in all cases. Therefore, upper portion 421 may be included in tub 400 with angle 423 and length 422 that may vary to enable correct dimensioning for connection to hood. Angled runoffs that are included in a tub wall can greatly reduce the thermal efficiency of the tub due to wash water that is sprayed by the wash arms and falls onto angled runoffs and is cooled due to the ambient air temperature on the opposite side of the angled runoffs. The internal angled runoffs within interior volume 440 may be maintained at an operating chamber temperature of the dishwashing machine. For example, cooling of the falling wash tank water is minimized by returning to battery of wash tank water interior volume 440 by one of two routes: (1) directly upon the scrap trays (not shown) and directly into the battery of water in interior volume 440 or (2) onto the internal angled runoffs and directed to the scrap trays and then falling into the battery of water in interior volume 440.

Similar to tub 200, tub 400 allows for the surface area at a water level height to be approximately an area covered by length L2 and width W2 allowing for a greater volume of water to be available in tub 400 than for units which incorporate the angled runoffs within the design of the tub walls decreasing width and a surface area by the angled runoffs. This greater volume or "battery" of water can maintain a higher temperature due its ability to absorb the same amount of cooler water that results in the washing process. This will enable greater ware throughput.

Tub 400 may be formed by method of manufacture described herein. The method of manufacture includes bending a single piece of material, for example, metal, to form tub wrap 405. The single piece of material has a same number of bends in tub wrap 405 for different lengths of tub 400. For example, tub wrap 405 may have seven bends for a one meter tub and seven bends for a four meter tub, and, similarly any lengths of tub would require the same amount of welding. The bends may be formed by stamping. The first tub end piece and the second tub end piece (not shown) may be stamped with a flange. Advantageously, tub 400 allows for tub designs with any number of bends and surfaces, nevertheless bends are to be minimized and thus, preventing excessive tolerance buildup as described herein. Bending may be minimized by the inclusion of the internal angled runoffs, so that tub wrap 405 does not have to direct all water within the tub 400.

The first tub end piece and second tub end piece may be welded, preferably seam welded, to tub wrap 405. Seam welding eliminates a need for MIG welding that may cause unsafe fumes; however, any welding may be used.

Tub 400 may have the same amount of welded joint regardless of length L2 due to a uniform cross-section along length L2 and due to welding only the first tub end piece and second tub end piece to tub wrap 405. The first tub end piece and second tub end piece may be exactly the same regardless of length L2 of tub 400. For example, a 25 inch door type machine will have the same overall weld length as a 120 inch conveyor type tub. Tub 400 may be any length reducing manufacturing costs for production of multiple types of dishwashing machines. Tub 400 may have at least 30 percent less welding than conventional tubs. Preferably, the welded portions of tub 400 are free of bends or flanges, which eliminates potential gaps created during the weld process. This allows for varying weld processes to be utilized, for example, butt joint weld, seam weld, and is conducive to robotic welding as well. Corners are greatly reduced in number and therefore potential crud traps with associated bacterial growth are eliminated allowing for ease of cleaning, and conforms closely to existing National Sanitation Foundation (NSF) and local health code standards.

It should also be noted that the terms "first", "second", "third", "upper", "lower", and the like may be used herein to modify various elements. These modifiers do not imply a spatial, sequential, or hierarchical order to the modified elements unless specifically stated.

While the present disclosure has been described with reference to one or more exemplary embodiments, it will be understood by those skilled in the art that various changes may be made and equivalents may be substituted for elements thereof without departing from the scope of the present disclosure. In addition, many modifications may be made to adapt a particular situation or material to the teachings of the disclosure without departing from the scope thereof. Therefore, it is intended that the present disclosure not be limited to the particular embodiment(s) disclosed as the best mode contemplated, but that the disclosure will include all embodiments falling within the scope of the appended claims.

What is claimed is:

1. A dishwashing machine comprising:

a hood having a first hood end piece, a second hood end piece, a hood wrap extending therebetween, and a door, a cross-section of said hood wrap being substantially semi-circular along its length and defining a door slot therein, said door being connected to said hood wrap on said door slot;

a tub having a first sidewall and a second sidewall connected by a bottom wall, a first end wall and a second end wall, said first end wall being connected to said first sidewall, said second sidewall and said bottom wall on a first end of said tub, and said second end wall being connected to said first sidewall, said second sidewall and said bottom wall on a second end of said tub, said hood being connected to said tub, thereby defining an interior volume; and a water source in fluid communication with said interior volume, wherein said first sidewall and said second sidewall are substantially parallel and a cross-section of said bottom wall is substantially semi-circular along its length from said first end of said tub to said second end of said tub, and said door is movable from an open position to a closed position so that said interior volume is accessible through said door slot.

2. The dishwashing machine of claim 1, wherein said first end wall and said second end wall are connected to said first sidewall, said second sidewall, and said bottom wall via welds.

3. The dishwashing machine of claim 1, wherein said first sidewall, said second sidewall and said bottom wall are formed from a single sheet of material.

4. The dishwashing machine of claim 1, wherein said first sidewall has a first edge and said second sidewall has a second edge that are bent outside of a connection with said first end wall and said second end wall.

5. The dishwashing machine of claim 1, wherein said first end wall and/or said second end wall are bent outside of a connection with said first sidewall and said second sidewall.

6. The dishwashing machine of claim 1, wherein said tub has an internal angled runoff within said tub that is a planar surface that directs liquid within said tub away from a corresponding one of said first sidewall, said second sidewall, said first end wall and said second end wall.

7. The dishwashing machine of claim 1, wherein said first sidewall has an upper portion that is bent outward away from said interior volume.

8. The dishwashing machine of claim 1, wherein said second sidewall extends above said first sidewall.

9. A dishwashing machine comprising:

a hood having a first hood end piece, a second hood end piece, a hood wrap extending therebetween, and a door, a cross-section of said hood wrap being substantially semi-circular along its length and defining a door slot therein, said door being connected to said hood wrap on said door slot;

a tub having a first sidewall and a second sidewall connected by a bottom wall, a first end wall and a second end wall, said first end wall being connected to said first sidewall, said second sidewall and said bottom wall on a first end of said tub, and said second end wall being connected to said first sidewall, said second sidewall and said bottom wall on a second end of said tub, said hood being connected to said tub, thereby defining an interior volume; and a water source in fluid communication with said interior volume, wherein said bottom wall is substantially semi-cylindrical in shape, and said door is movable from an open position to a closed position so that said interior volume is accessible through said door slot.

10. The dishwashing machine of claim 9, wherein said first sidewall forms an angle of about 70 degrees to about 90 degrees with a horizontal plane that passes through a connection between said bottom wall and said first sidewall and a connection between said bottom wall and said second sidewall and said second sidewall forms an angle of about 70 degrees to about 90 degrees with said horizontal plane.

11. The dishwashing machine of claim 9, wherein said first sidewall and said second sidewall are planar.

12. The dishwashing machine of claim 9, wherein said first sidewall and said second sidewall are substantially parallel.

13. The dishwashing machine of claim 9, wherein said first sidewall and said second sidewall are perpendicular to said first end wall and said second end wall.

14. The dishwashing machine of claim 9, wherein said first end wall and said second end wall are connected to said first sidewall, said second sidewall, and said bottom wall via welds.

15. The dishwashing machine of claim 9, wherein said first sidewall, said second sidewall and said bottom wall are formed from a single sheet of material.

* * * * *

UNITED STATES PATENT AND TRADEMARK OFFICE

CERTIFICATE OF CORRECTION

PATENT NO. : 8,747,571 B2
APPLICATION NO. : 12/459776
DATED : June 10, 2014
INVENTOR(S) : James S. Calhoun et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1026 days.

Signed and Sealed this
Twelfth Day of July, 2016

Michelle K. Lee

Michelle K. Lee
*Director of the United States Patent and Trademark Office*